US010946439B2

(12) United States Patent
Chen et al.

(10) Patent No.: US 10,946,439 B2
(45) Date of Patent: Mar. 16, 2021

(54) PLASTER CASTING MOLD FABRICATION METHOD FOR A COMPLICATED STRUCTURE ALUMINUM ALLOY CASTING WITH A LARGE INNER CAVITY AND A THIN WALL

(71) Applicant: No.59 Institute of China Ordnance Industry, Chongqing (CN)

(72) Inventors: Qiang Chen, Chongqing (CN); Yuanyuan Wan, Chongqing (CN); Zhihui Xing, Chongqing (CN); Gaozhan Zhao, Chongqing (CN); Jianquan Tao, Chongqing (CN); Zhiwei Huang, Chongqing (CN); Ming Li, Chongqing (CN); Yanbin Wang, Chongqing (CN); Shuxin Chai, Chongqing (CN); Hong Zhan, Chongqing (CN); Maochuan Wang, Chongqing (CN); Xiaohui Lin, Chongqing (CN)

(73) Assignee: No.59 Institute of China Ordnance Industry, Chongqing (CN)

( * ) Notice: Subject to any disclaimer, the term of this patent is extended or adjusted under 35 U.S.C. 154(b) by 0 days.

(21) Appl. No.: 16/704,770

(22) Filed: Dec. 5, 2019

(65) Prior Publication Data

US 2020/0324334 A1 Oct. 15, 2020

(30) Foreign Application Priority Data

Apr. 15, 2019 (CN) ..... 201910298688.9

(51) Int. Cl.

| | |
|---|---|
| ***B22D 23/00*** | (2006.01) |
| ***B22D 21/04*** | (2006.01) |
| ***B22D 25/06*** | (2006.01) |
| ***B22D 39/06*** | (2006.01) |

(52) U.S. Cl.

CPC ..... *B22D 23/006* (2013.01); *B22D 21/04* (2013.01); *B22D 25/06* (2013.01); *B22D 39/06* (2013.01)

(58) Field of Classification Search

CPC ..... B22D 23/006; B22D 21/04; B22D 25/06; B22D 39/06; B22C 9/00; B22C 9/02; B22C 9/03; B22C 9/04; B22C 7/00; B22C 7/02

See application file for complete search history.

(56) References Cited

FOREIGN PATENT DOCUMENTS

| | | |
|---|---|---|
| CN | 102728819 | 4/2014 |
| CN | 105215272 | 1/2016 |
| CN | 106583648 | 8/2018 |

*Primary Examiner* — Kevin P Kerns
*Assistant Examiner* — Steven S Ha
(74) *Attorney, Agent, or Firm* — Rankin, Hill & Clark LLP

(57) ABSTRACT

The application provides a plaster casting mold fabrication method for a complicated structure aluminum alloy casting with a large inner cavity and a thin wall, in which, a wax pattern is cleaned with a mixture; closed blind cavity and large plane unbeneficial to plaster mold-filling of the wax pattern are used to exhaust air by using vent holes and waterproof-breathable membranes in cooperation with each other; under pressure difference, plaster powder and mixed aqueous solution are vertically splashed and mixed in a mixing tank to reduce dust discharge; asynchronous mixing and grouting can be realized by left and right mixing tanks in an upper tank of a vacuum tank. The present application can effectively remove the surface parting agent, increase the wettability of the plaster paste and the wax pattern surface, and improve the surface finish of the casting mold.

5 Claims, 4 Drawing Sheets

S101 fabricating a wax pattern by using a wax injection mold of aluminum alloy material; placing the wax pattern in tap water to be shaped; splashing and cleaning the internal surface and outer surface of the wax pattern with a mixture; opening through-holes on a partition; sticking and covering the upper and lower surfaces of the holes with circle TPU waterproof-breathable membranes by using AB adhesive

S102 separating a sealed tank into an upper tank and a lower tank which are two independent spaces by a middle partition, and the upper tank and the lower tank are respectively externally connected to independent pressure adjusting systems through valved pipelines. and left and right sealed mixing tanks are respectively placed in the upper gas chamber; the upper portion of each of the left and right mixing tanks is provided with a gas-pressure adjusting valved pipeline, and the lower portion of each of the left and right mixing tanks is provided with a plaster slurry discharge valved pipeline; a spiral stirrer is installed in the center of the upper cover of each of the left and right mixing tanks, and the spiral stirrer can rise and fall vertically along the axis line of the mixing tank; one mixed plaster powder feeding valved pipeline and one mixed aqueous solution feeding pipeline are distributed symmetrically on the circumference of each of the left and right mixing tanks, which is 100~110mm away from the upper plane of the mixing tank; the other end of the plaster powder feeding valved pipeline is connected to a plaster powder quantitative supply bucket, and the other end of the mixed aqueous solution feeding pipeline is simultaneously connected to a mixed aqueous solution quantitative supply bucket and a tap water bucket via two valved pipelines in a parallel connection manner; the center lines of the plaster powder feeding valved pipeline and the mixed aqueous solution feeding pipeline are in the same straight line, and an angle between the center line and the axis line of the mixing tank is 90°

S103 placing the sand box to be grouted and an annular cleaning water box on a rotatable wheel plate of the lower tank together, wherein an angle between a central axis line of a cleaning water box water inlet and a central axis line of a sand box feed inlet is 45°; the lower tank is transferred below the middle partition by a guide rail, and the sand box feed inlet directly faces to the bottom of the plaster slurry transfer tube; a hydraulic lifting pump of the middle partition is adjusted so that the middle partition falls down and steadily contacts with the lower tank, and a leak-proof isolation is performed on the contact parts between the upper tank and the middle partition as well as the middle partition and the lower tank by using two sets of rubber pads

S104 making valves of all the pipelines in the upper tank and the lower tank be in a close state, turning on the valved pipelines between each of the upper tank and the lower tank, and turning off the valved pipelines when the pressure of the upper tank and lower tank reaches to preset values; turning on the valve of gas-pressure adjusting valved pipeline of each of the left and right mixing tanks so that the pressure in the left and right mixing tanks reaches to -0.02~-0.03MPa; then turning on, for the left and right mixing tanks, the plaster powder feeding valved pipeline, the mixed aqueous solution feeding pipeline and the valve between the mixed aqueous solution feeding pipeline and the mixed aqueous solution quantitative supply bucket, so that the initial mixing of the plaster powder and the mixed aqueous solution; after the plaster powder and the mixed aqueous solution completely enter into the left and right mixing tanks, turning off the turned-on valve, and adjusting the gas pressure in each of the left and right mixing tanks by the valve of the gas-pressure adjusting valved pipeline of each of the left and right mixing tanks; at the same time, making the spiral stirrer in each of the left and right mixing tanks fall and stir the plaster slurry

S105 raising the spiral stirrers to the highest position on the top of the left and right mixing tanks after the stirring is completed, and respectively turning on the valve of the discharge valved pipeline at the bottom of each of the left and right mixing tanks so that the plaster slurry in the each of the left and right mixing tanks flows into the plaster slurry transfer tube via the discharge valved pipeline; and turning on the valve of the plaster slurry transfer tube, within 3~5s after the discharge valved pipeline at the bottom of each of the left and right mixing tanks is turned on, so that the upper tank and the lower tank are conducted each other and the plaster slurry enters into the sand box to be filled in the lower tank

S106 rotating the rotatable wheel plate in the lower tank by 45° after the sand box in the lower tank is fully filled with the plaster slurry, so that the cleaning water box water inlet is aligned with the lower end of the plaster slurry transfer tube; at the same time, turning on, for the left and right mixing tanks, the mixed aqueous solution feeding pipeline and the valve between the mixed aqueous solution feeding pipeline and the tap water bucket, so that tap water sequentially enters into the left and right mixing tanks, the discharge valved pipelines and the plaster slurry transfer tube to perform a flushing processing on the residual plaster slurry; turning off the all turned-on valves after the flushing processing is completed; and then separately turning on the pressure adjusting system of the lower tank so that the pressure of the lower tank becomes to atmospheric pressure

S107 adjusting the hydraulic lifting pump of the middle partition to make the middle partition rise and transfer the lower tank to a region other than the gravity projection area of the middle partition by the guide rail, and lift out the sand box filled with plaster in the lower tank by using a crane

S108 performing a mixing and grouting process separately or simultaneously by the left and right tanks

FIG. 1

PLASTER CASTING MOLD FABRICATION METHOD FOR A COMPLICATED STRUCTURE ALUMINUM ALLOY CASTING WITH A LARGE INNER CAVITY AND A THIN WALL

CROSS REFERENCE TO RELATED APPLICATIONS

The present application claims priority to Chinese Patent Application No. 201910298688.9 filed on Apr. 15, 2019, the entire content of which are incorporated herein by reference.

TECHNICAL FIELD

The present application relates to a technical field of aluminum alloy manufacturing, particularly to a plaster casting mold fabrication method of a complicated structure aluminum alloy casting with a large inner cavity and a thin wall.

BACKGROUND

Aluminum alloy has characteristics of excellent corrosion resistance, casting fluidity, good toughness and specific rigidity, and has been widely applied to a casting and molding of a large diameter shell member in a field of aviation, aerospace and weapons. At present, the conventional casting methods of aluminum alloy members include metal mold casting, sand mold casting, shell mold casting, plaster mold investment casting, expendable pattern casting (EPC) and so on. With the continuous progress of the strategy of reducing weight and increasing efficiency in the industry field, it has become a hot topic of technical development at home and abroad to fabricate a large-inner-cavity and complicated-structure aluminum alloy castings with large-area inner cavity partition or deep blind cavity, main body wall thickness ≤3 mm and maximum contour size ≥800 mm by a plaster mold investment casting method, and has an important application prospect.

However, when aluminum alloy castings are produced by a plaster mold investment casting method, aluminum alloy castings produced by the plaster mold investment casting method possess defects such as irregular plane projections, granular projections, contour size out-of-tolerance and large size flash due to worse mold fitness, air entrainment, crack and delamination easily generated in mixing, stirring and pouring processes. Although a series of solutions for the above problems have been developed in the prior art, it is difficult for the prior art to ensure the mold fabrication quality and qualification rate of surface roughness of aluminum alloy casting formed one time, for an investment plaster mold of large-inner-cavity and complicated-structure aluminum alloy castings with large-area inner cavity partition or deep blind cavity, main body wall thickness ≤3 mm and maximum contour size ≥800 mm.

It is found by the document retrieval that the China patent application publication No. CN105215272A discloses a method of a microstructure plaster mold. In the patent, plaster slurry is mixed under constant conditions, and then a pouring and a secondary ultrasonic treatment for plaster slurry are performed under the action of ultrasonic wave. The method can produce the fine structure about 100 μm on the mold, the surface finish of the casting mold is high, and the crack of casting mold is reduced obviously. But this technique is to stir plaster at atmospheric temperature and pressure, and based on the characteristics of plaster slurry, such as high density, high viscosity and fast solidification, a powerful and fast stirring device must be used; If a stirring is performed at atmospheric temperature and pressure, it will inevitably cause plenty of air entrainment inside the slurry; Although ultrasonic treatment is useful for clearing the plenty of air entrainment in plaster slurry, it may lead to insufficient bubble clearing in the casting mold and premature solidification of the casting mold in the process of clearing gas for large plaster casting mold, due to characteristics of the limited area and long duration of ultrasonic treatment; especially for aluminum alloy casting mold with large area partition or partially closed blind cavity, this method is not sufficient to deal with the breath-holding phenomenon of the blind cavity part of the casting mold.

It is found by the document retrieval that the China patent application publication No. CN106583648B discloses a vacuum molding device of a plaster casting mold. The device mainly includes a vacuum molding chamber, a transfer boom and a plaster vacuum mixing chamber, and during the operation of the device, the vacuum mixing is firstly performed in the plaster vacuum mixing chamber, then the plaster vacuum mixing chamber as a whole is hoisted to the vacuum molding chamber, and finally, the vacuum pouring molding for plaster slurry is completed under the vacuum environment inside the vacuum molding chamber; By using this device, the vacuum stirring and vacuum pouring of plaster slurry can be realized, the air entrainment of plaster slurry can be avoided effectively, and the mold-filling performance of plaster slurry can be improved. However, this technology belongs to the single-beat mixing and pouring process. After each pouring, the door of the vacuum molding chamber must be opened to take out the vacuum mixing chamber, and then operations such as vacuuming and mixing of the vacuum mixing chamber, closing of the molding chamber, and vacuuming of the vacuum molding chamber are repeatedly performed, which is disadvantageous to continuous productions. In addition, the device and method have no design of air exhaust measures for the casting mold structures with large-area partitions or partially closed blind cavity without specifying the vacuum degree that can be achieved by vacuum molding, which may lead to residual gas in blind cavity of casting mold when large-contour-size plaster casting mold with a partially closed structure is fabricated, and thus to reduce the surface quality and dimensional accuracy of aluminum alloy casting.

To sum up, the problems existing in the prior art are as follows:

(1) It is difficult to ensure the mold fabrication quality and qualification rate of surface roughness of aluminum alloy casting molded one time, when large-inner-cavity and complicated-structure aluminum alloy casting with large-area inner cavity partition or deep blind cavity, main body wall thickness ≤3 mm and maximum contour size ≥800 mm is fabricated by the plaster mold investment casting method.

(2) Treatment of the plaster slurry by ultrasonic may lead to insufficient bubble clearing in the casting mold and premature solidification of the casting mold in the process of clearing gas.

(3) It is required to repeatedly perform vacuuming operation after the pouring for the vacuum plaster casting mold is completed, which is disadvantageous to continuous productions; moreover, there is no design of air exhaust measures for the casting mold structures with large-area partitions or partially closed blind cavity, so as to lead to residual gas in blind cavity of casting mold and thus to reduce the surface quality and dimensional accuracy of aluminum alloy casting.

SUMMARY

In view of the above problems in the prior art, the present application provides a plaster casting mold fabrication method of a complicated structure aluminum alloy casting with a large inner cavity and a thin wall. The present application is a plaster casting mold fabrication method with good mold fitness, good air exhaust, fast mixing speed, good consistency of plaster casting mold, good surface quality of casting and achievable continuous production. The present method is simple in operation and high in integration degree, easy to be widely used in industrial production, and has great significance to promote the promotion and application of plaster mold investment casting method in large thin-walled aluminum alloy casting with semi-closed or partially closed blind cavity structure.

The present application is achieved as follows: a plaster casting mold fabrication method of a complicated structure aluminum alloy casting with a large inner cavity and a thin wall, in which a wax pattern is cleaned with a mixture of acetone and industrial ethanol; closed blind cavity and large plane unbeneficial to plaster mold-filling of the wax pattern exhaust air by using vent holes and waterproof-breathable membranes in cooperation with each other; under the action of pressure difference, plaster powder and mixed aqueous solution are vertically splashed and mixed in mixing tanks to reduce dust discharge; the plaster slurry is controlled by the pressure difference to be filled into a sand box in which the wax pattern is placed in vacuum by the step pressure difference; asynchronous mixing and grouting can be realized by left and right mixing tanks in an upper tank of a vacuum tank.

Furthermore, the plaster casting mold fabrication method of a complicated structure aluminum alloy casting with a large inner cavity and a thin wall comprises:

Step 1: fabricating a wax pattern by using a wax injection mold of aluminum alloy material; placing the wax pattern in tap water of 20~24° C. for 25~35 minutes to be shaped; then splashing and cleaning the internal surface and outer surface of the wax pattern with a mixture of acetone and industrial ethanol; opening through-holes on blind cavity in the wax pattern of which the depth is more than 20 mm with respect to the opposite direction of gravity and/or on a partition which is vertical to the gravity direction and has an area of more than 1600 $mm^2$ by using a drill bit with a diameter of 3~6 mm, wherein the axis lines of the holes are parallel to the gravity direction, and the distance between the holes is 20~40 mm; sticking and covering the upper and lower surfaces of the holes with circle TPU waterproof-breathable membranes with thickness of 0.16~0.24 mm by using AB adhesive; and then placing the wax pattern in a sand box to be grouted.

Step 2: separating a sealed tank into an upper tank and a lower tank which are two independent spaces by a middle partition, wherein the upper tank and the lower tank can be used as two gas chambers in which gas pressure is controlled independently by a valve on a plaster slurry transfer tube, and the upper tank and the lower tank are respectively externally connected to independent pressure adjusting systems through valved pipelines, and left and right sealed mixing tanks are respectively placed in the upper gas chamber; the upper portion of each of the left and right mixing tanks is provided with a gas-pressure adjusting valved pipeline, and the lower portion of each of the left and right mixing tanks is provided with a plaster slurry discharge valved pipeline; the gas-pressure adjusting valved pipelines can independently perform a gas pressure control relative to the upper tank, and the plaster slurry discharge valved pipelines are connected with the plaster slurry transfer tube; a spiral stirrer is installed in the center of the upper cover of each of the left and right mixing tanks, and the spiral stirrer can rise and fall vertically along the axis line of the mixing tank; when the spiral stirrer rises to the highest point, its upper end is 60 mm away from the lower plane of the upper cover of the mixing tank, and when the spiral stirrer falls to the lowest point, its lower end is 40 mm away from the inner bottom plane of the mixing tank; one mixed plaster powder feeding valved pipeline and one mixed aqueous solution feeding pipeline are distributed symmetrically on the circumference of each of the left and right mixing tanks, which is 100~110 mm away from the upper plane of the mixing tank; the other end of the plaster powder feeding valved pipeline is connected to a plaster powder quantitative supply bucket, and the other end of the mixed aqueous solution feeding pipeline is simultaneously connected to a mixed aqueous solution quantitative supply bucket and a tap water bucket via two valved pipelines in a parallel connection manner; the center lines of the plaster powder feeding valved pipeline and the mixed aqueous solution feeding pipeline are in the same straight line, and an angle between the center line and the axis line of the mixing tank is 90°;

Step 3: placing the sand box to be grouted and an annular cleaning water box on a rotatable wheel plate of the lower tank together, wherein an angle between a central axis line of a cleaning water box water inlet and a central axis line of a sand box feed inlet is 45°; the lower tank is transferred below the middle partition by a guide rail, and the sand box feed inlet directly faces to the bottom of the plaster slurry transfer tube; a hydraulic lifting pump of the middle partition is adjusted so that the middle partition falls down and steadily contacts with the lower tank, wherein a leak-proof isolation is performed on the contact parts between the upper tank and the middle partition as well as the middle partition and the lower tank by using two sets of rubber pads;

Step 4: making valves of all the pipelines in the upper tank and the lower tank be in a close state, turning on the valved pipelines between each of the upper tank and the lower tank and the externally connected independent vacuum system to adjust the pressure in the upper tank to −0.05~−0.055 MPa and adjust the pressure in the lower tank to −0.055~−0.06 MPa, and respectively turning off the valved pipelines between each of the upper tank and the lower tank and the externally connected independent vacuum system when the pressure of the upper tank and lower tank reaches to preset values; turning on the valve of gas-pressure adjusting valved pipeline of each of the left and right mixing tanks so that the pressure in the left and right mixing tanks reaches to −0.02~−0.03 MPa; then respectively turning on, for the left and right mixing tanks, the plaster powder feeding valved pipeline, the mixed aqueous solution feeding pipeline and the valve between the mixed aqueous solution feeding pipeline and the mixed aqueous solution quantitative supply bucket, so that each of the left and right mixing tanks is respectively conducted with the plaster powder quantitative supply bucket and the mixed aqueous solution quantitative supply bucket at atmospheric pressure, and under the action of pressure difference, the quantitative plaster powder and quantitative mixed aqueous solution are inhaled into the left and right mixing tanks at high speed, and the initial mixing of the plaster powder and the mixed aqueous solution is realized by the collision between the plaster powder and the mixed aqueous solution; after the plaster powder and the mixed aqueous solution completely enter into the left and right mixing tanks, turning off, for left and right mixing tanks, the plaster powder feeding valved pipeline, the mixed aqueous solution feeding pipeline and the valve between the mixed aqueous solution feeding pipeline and the mixed aqueous solution quantitative supply bucket, and adjusting the gas pressure in each of the left and right mixing tanks to −0.04~−0.05 MPa by the valve of the gas-pressure adjusting valved pipeline of each of the left and right mixing tanks; at the same time, making the spiral stirrer in each of the left and right mixing tanks fall and stir the plaster slurry at a speed of 540~650 RPM, the bottom of the spiral stirrer is 40 mm away from the bottom of the mixing tank, and the stirring time is 120~180 s;

Step 5: raising the spiral stirrers to the highest position on the top of the left and right mixing tanks after the stirring is completed, and respectively turning on the valve of the discharge valved pipeline at the bottom of each of the left and right mixing tanks so that the plaster slurry in the each of the left and right mixing tanks flows into the plaster slurry transfer tube via the discharge valved pipeline under the action of gravity and pressure difference; and turning on the valve of the plaster slurry transfer tube, within 3~5 s after the discharge valved pipeline at the bottom of each of the left and right mixing tanks is turned on, so that the upper tank and the lower tank are conducted each other and the plaster slurry enters into the sand box to be filled in the lower tank via the sand box feed inlet under the action of gravity and pressure difference;

Step 6: rotating the rotatable wheel plate in the lower tank by 45° after the sand box in the lower tank is fully filled with the plaster slurry, so that the cleaning water box water inlet is aligned with the lower end of the plaster slurry transfer tube; at the same time, turning on, for the left and right mixing tanks, the mixed aqueous solution feeding pipeline and the valve between the mixed aqueous solution feeding pipeline and the tap water bucket, so that under the action of pressure difference, tap water sequentially enters into the left and right mixing tanks, the discharge valved pipelines and the plaster slurry transfer tube to perform a flushing processing on the residual plaster slurry, wherein the flushing time is 10~20 s, and the flushed tap water flows into the cleaning water box via the cleaning water box water inlet; turning off the all turned-on valves after the flushing processing is completed; and then separately turning on the pressure adjusting system of the lower tank so that the pressure of the lower tank becomes to atmospheric pressure;

Step 7: adjusting the hydraulic lifting pump of the middle partition to make the middle partition rise and transfer the lower tank to a region other than the gravity projection area of the middle partition by the guide rail, and lift out the sand box filled with plaster in the lower tank by using a crane;

Step 8: performing a roasting process on the sand box filled with plaster to remove the wax pattern in the sand box and obtain a plaster casting mold.

Further, in the method, the left and right tanks can perform the mixing and grouting processes independently or simultaneously.

Further, in the step 1, the ratio of acetone and industrial ethanol in the mixture is 1~1.8:9~8.2.

Further, in the step 1, the waterproof-breathable membrane has the waterproof level of IPX4~IPX6, the diameter of the waterproof-breathable membrane is 8~14 mm, and the deviation of the center of the waterproof-breathable membrane from the center of the covered circular hole is no more than 2 mm.

Further, in the Step 5, the height difference in the top plane of plaster slurry in the inside and outside of the wax pattern in the sand box is not more than 10 mm.

Another purpose of the present application is to provide a plaster casting mold for a complicated structure aluminum alloy casting with a large inner cavity and a thin wall, which is fabricated by the plaster casting mold fabrication method for a complicated structure aluminum alloy casting with a large inner cavity and a thin wall.

To sum up, the advantages and positive effects of the present application are as follows:

In considering of the defects in the prior art, the present application develops, on the basis of previous researches, a plaster casting mold fabrication method, in which the stirring and grouting for plaster slurry is completed under vacuum, gas is exhausted in large area partition or partially blind cavity and an asynchronous continuous mixing and pouring can be achieved. The present method is simple in operation and high in integration degree, easy to be widely used in industrial production, and has great significance to promote the promotion and application in the aerospace field of plaster mold investment casting method in large thin-walled aluminum alloy casting with semi-closed or partially closed blind cavity structure.

By cleaning the wax pattern with the mixture of acetone and industrial alcohol, the present application can effectively remove the parting agent on the surface of the wax pattern, increase the wettability of the plaster paste and the surface of the wax pattern, and prevent the tiny needle-like pores between the wax pattern and the plaster paste; by prefabricating through-holes and sticking waterproof-breathable membrane in large area partition or portion of the partially closed blind cavity of the wax pattern, the residual gas remained during the grouting for the wax pattern is discharged outside the casting mold so as to prevent the defects such as pattern-based projections at blind cavity bottom, large irregular plane projections, and granular projections from being generated in the casting, and thus improve the surface finish of the aluminum alloy casting and reduce subsequent polishing and finishing workload; by setting three levels of independent vacuum environment, the plaster slurry with higher viscosity can be transferred and used for grouting under the action of gravity and pressure difference so that the residual amount in containers and pipelines can be reduced, and the vacuum degree of the environment where the plaster slurry is during the whole grouting is higher and higher with the advance of the process flow so that the amount of gas contained in the slurry can be effectively reduced and the secondary air entrapment can be prevented; the mixing and stirring process of the plaster powder and the mixed aqueous solution are performed in a closed environment, and the plaster powder and aqueous solution are mixed due to splashing and collision when they enter into the tank, which greatly reduces the mixing and fabricating time of the plaster, improves the mixing evenness of the plaster slurry, and greatly reduces the influence on the environment; by controlling the mixing work in left and right mixing tanks separately or simultaneously, it can realize the uninterrupted fabrication and continuous grouting of the plaster slurry with respect to the demand on large capacity and rapid grouting of large sand box, and prevent the distribution and solidification phenomena of the plaster slurry due to too long mixing time interval so as to prevent defects such as the uneven shrinkage, cracking and fracture from being occurred in the casting mold in the process of roasting and pouring the aluminum alloy melt, so that the problems of oversize, mismatch and fire of the aluminum alloy casting caused by the casting mold defects can be effectively avoided.

The maximum circumcircle diameter of granular projections on the inner and outer surfaces of aluminum alloy castings produced by the investment plaster casting mold fabricated by the present application is ≤3 mm; there are no more than 2 projections with diameter greater than 2 mm within an area of 30×30 mm on the surface of aluminum alloy casting; dimension tolerance of the casting is CT6~CT7; and there is no crack in the casting.

BRIEF DESCRIPTION OF THE DRAWINGS

FIG. 1 is a flow chart of a plaster casting mold fabrication method of a complicated structure aluminum alloy casting with a large inner cavity and a thin wall provided in the embodiment of the present application.

REFERENCE SIGNS IN THE DRAWINGS

Figure 2:
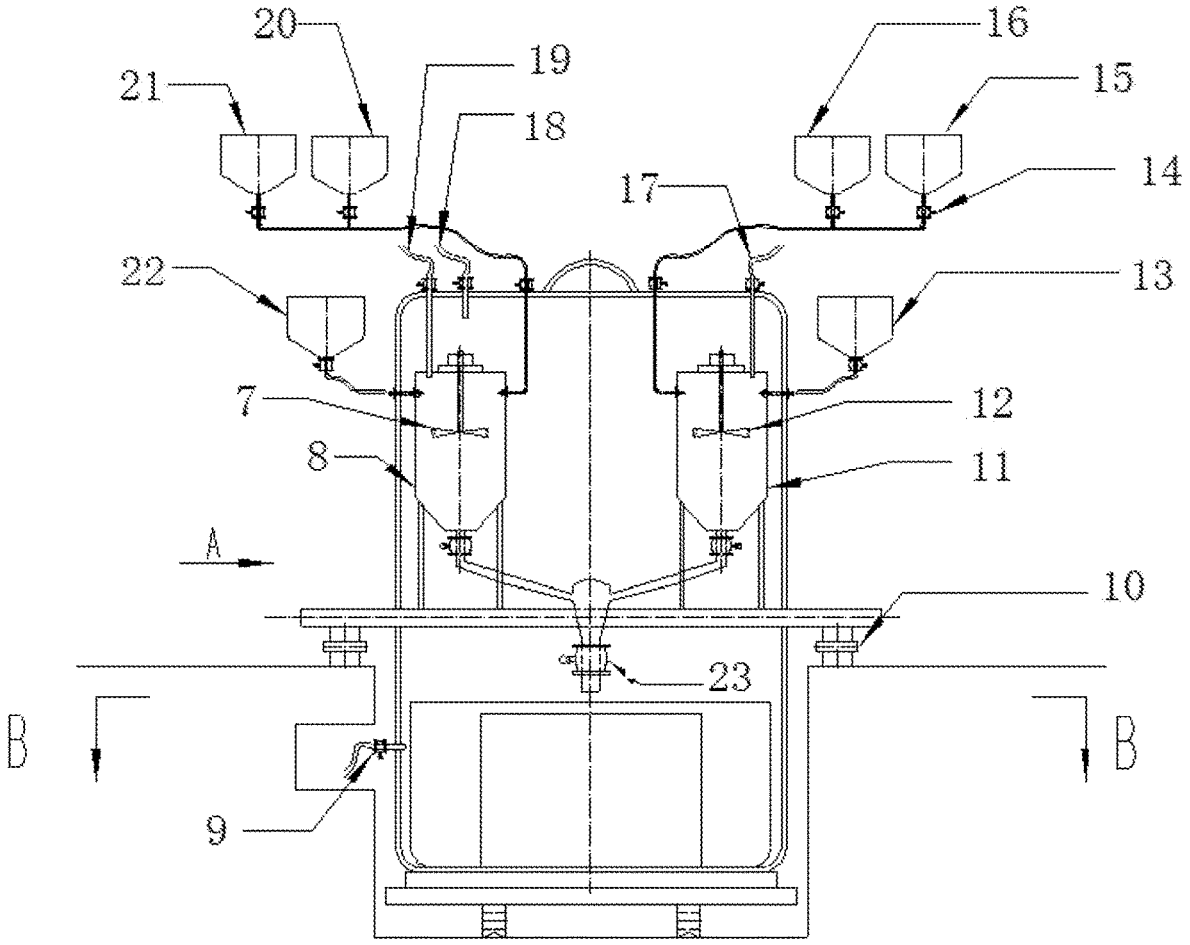
FIG. 2 is a front view of an internal structure of a device for fabricating a plaster casting mold of a complicated structure aluminum alloy casting with a large inner cavity and a thin wall provided in the present application.
Figure 3:
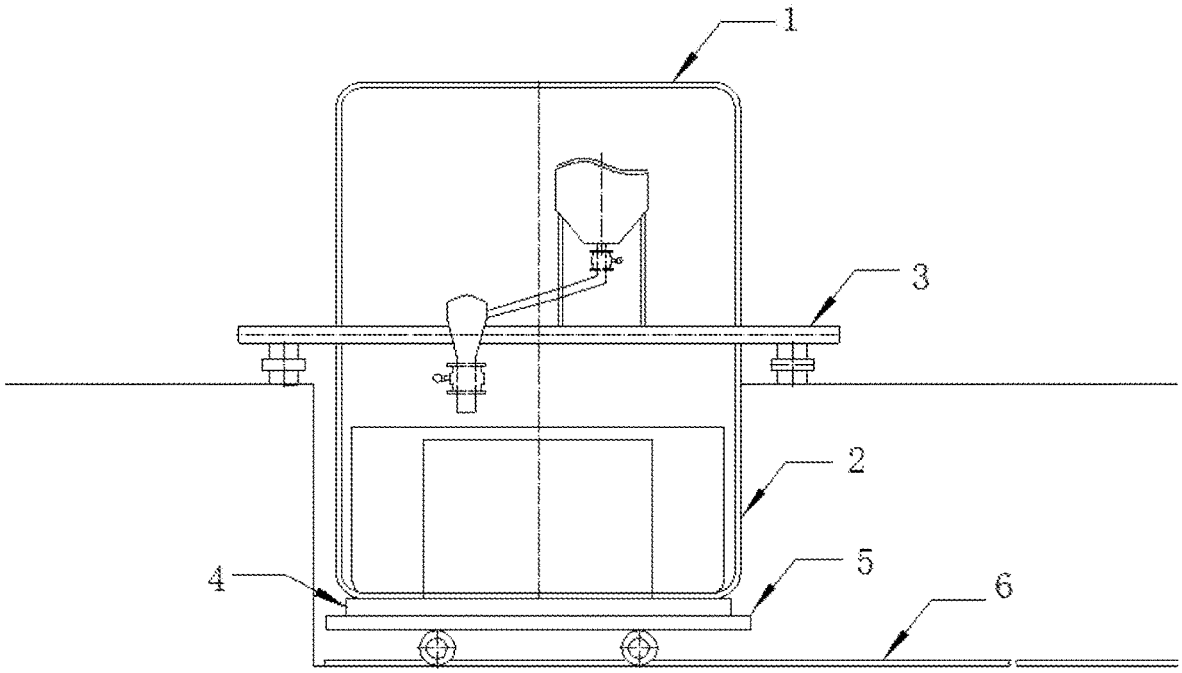
FIG. 3 is a partial left view of a device for fabricating a plaster casting mold of a complicated structure aluminum alloy casting with a large inner cavity and a thin wall provided in the present application.
Figure 4:
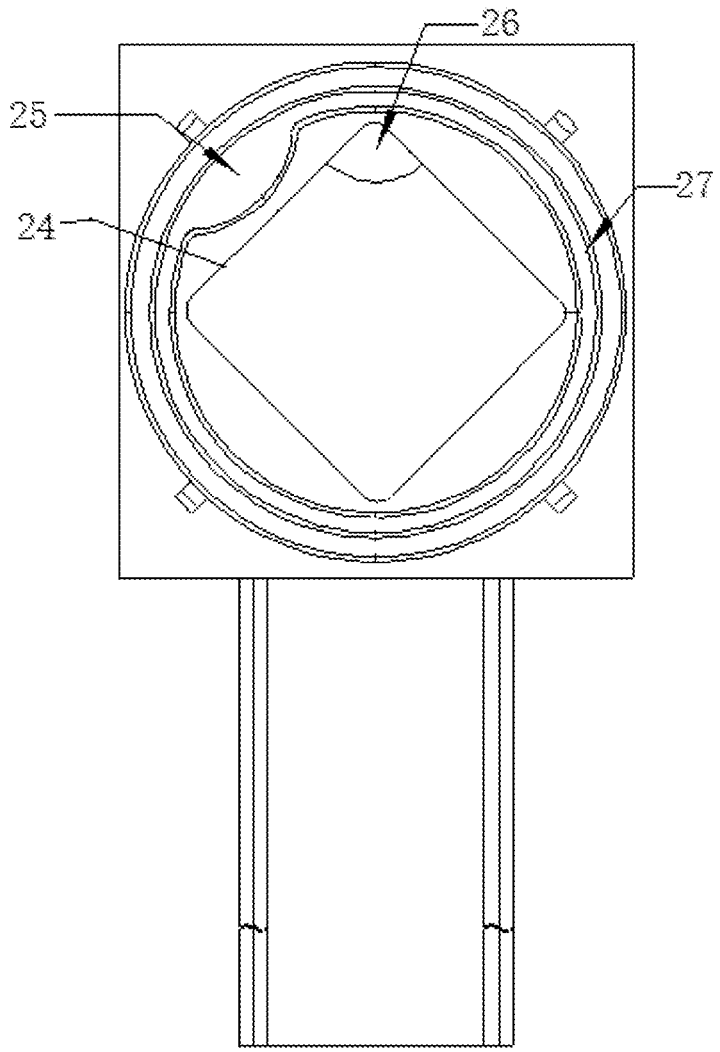
FIG. 4 is a partial section view of a device for fabricating a plaster casting mold of a complicated structure aluminum alloy casting with a large inner cavity and a thin wall provided in the present application.

1 upper tank; 2 lower tank; 3 middle partition; 4 rotatable wheel plate; 5 bottom board; 6 guide rail; 7 left spiral stirrer; 8 left mixing tank; 9 lower tank pressure adjusting valve; 10 hydraulic lifting pump of middle partition; 11 right mixing tank; 12 right spiral stirrer; 13 plaster powder quantitative supply bucket of right mixing tank; 14 valve; 15 mixed aqueous solution quantitative supply bucket of right mixing tank; 16 right tap water bucket; 17 gas-pressure adjusting valved pipeline of right mixing tank; 18 upper tank pressure adjusting valve; 19 gas-pressure adjusting valved pipeline of left mixing tank; 20 left tap water bucket; 21 mixed aqueous solution quantitative supply bucket of left mixing tank; 22 plaster powder quantitative supply bucket of left mixing tank; 23 plaster slurry transfer tube; 24 sand box; 25 cleaning water box water inlet; 26 sand box feed inlet; 27 cleaning water box

DESCRIPTION OF THE EMBODIMENTS

In order to make the purpose, technical solution and advantages of the present application more clear, the present application is further described in detail below in combination with the following embodiments. It should be understood that the following embodiments are only used to explain the present application but not intended to limit the present application.

In the plaster casting mold fabrication method of a complicated structure aluminum alloy casting with a large inner cavity and a thin wall, a wax pattern is cleaned with a mixture of acetone and industrial ethanol; closed blind cavity and large plane unbeneficial to plaster mold-filling of the wax pattern exhaust gas by using vent holes and waterproof-breathable membrane in cooperation with each other; under the action of pressure difference, plaster powder and mixed aqueous solution are vertically splashed and mixed in the mixing tank to reduce dust discharge; the plaster slurry is controlled by the pressure difference to be filled into a sand box in vacuum by the step pressure difference; the asynchronous mixing and grouting can be realized by left and right mixing tanks in the upper tank of the vacuum tank.

The application principles of the present application are described in detail in combination with the drawings.

As shown in FIG. 1, the plaster casting mold fabrication method of a complicated structure aluminum alloy casting with a large inner cavity and a thin wall comprises the following steps:

S101: fabricating a wax pattern by using a wax injection mold of aluminum alloy material; placing the wax pattern in tap water of 20~24° C. for 25~35 minutes to be shaped; then splashing and cleaning the internal surface and outer surface of the wax pattern with a mixture of acetone and industrial ethanol. Through-holes are opened on blind cavity in the wax pattern of which the depth is more than 20 mm with respect to the opposite direction of gravity and/or on a partition which is vertical to the gravity direction and has an area of more than 1600 $mm^2$ by using a drill bit with a diameter of 3~6 mm, wherein the axis lines of the holes are parallel to the gravity direction, and the distance between the holes is 20~40 mm; the upper and lower surfaces of the holes are stuck and covered with circle TPU waterproof-breathable membranes with thickness of 0.16~0.24 mm by using AB adhesive; and then the wax pattern are placed in a sand box to be grouted.

S102: separating a sealed tank into an upper tank 1 and a lower tank 2 which are two independent spaces by a middle partition 3, wherein the upper tank 1 and the lower tank 2 can be used as two gas chambers in which gas pressure is controlled independently by a valve on a plaster slurry transfer tube 23, and the upper tank 1 and the lower tank 2 are respectively externally connected to independent pressure adjusting systems through valved pipelines 18 and 9, and left and right sealed mixing tanks 8 and 11 are respectively placed in the upper gas chamber (the upper tank 1). The upper portion of each of the left and right mixing tanks is provided with a gas-pressure adjusting valved pipeline 19 and 17, and the lower portion of each of the left and right mixing tanks is provided with a plaster slurry discharge valved pipeline, wherein the gas-pressure adjusting valved pipelines 19 and 17 can control gas pressure independently relative to the upper tank, the plaster slurry discharge valved pipelines is connected with the plaster slurry transfer tube 23, a spiral stirrer 7 and 12 is installed in the center of the upper cover of each of the left and right mixing tanks, and the spiral stirrer can rise and fall vertically along the axis line of the mixing tank; when the spiral stirrer rises to the highest point, its upper end is 60 mm away from the lower plane of the upper cover of the mixing tank, and when the spiral stirrer falls to the lowest point, its lower end is 40 mm away from the inner bottom plane of the mixing tank; one mixed plaster powder feeding valved pipeline and one mixed aqueous solution feeding pipeline are distributed symmetrically on the circumference of each of the left and right mixing tanks 8 and 11, which is 100~110 mm away from the upper plane of the mixing tank; the other end of the plaster powder feeding valved pipeline is connected to a plaster powder quantitative supply bucket 13 and 22, and the other end of the mixed aqueous solution feeding pipeline is simultaneously connected to a mixed aqueous solution quantitative supply bucket 15 and 21 and a tap water bucket 16 and 20 via two valved pipelines in a parallel connection manner; the center lines of the plaster powder feeding valved pipeline and the mixed aqueous solution feeding pipeline are in the same straight line, and an angle between the center line and the axis line of the mixing tank is 90°.

S103: placing a sand box 24 to be grouted and an annular cleaning water box 27 together on a rotatable wheel plate 4 of the lower tank 2, wherein an angle between a central axis line of a cleaning water box water inlet 25 and a central axis line of a sand box feed inlet 26 is 45°; the lower tank is transferred below the middle partition by a guide rail 6, and the sand box feed inlet directly faces to the bottom of the plaster slurry transfer tube; a hydraulic lifting pump 10 of the middle partition is adjusted so that the middle partition 3 falls down and steadily contacts with the lower tank 2, and a leak-proof isolation is performed on the contact parts between the upper tank 1 and the middle partition 3 as well as the middle partition 3 and the lower tank 2 by using two sets of rubber pads.

S104: Making valves of all the pipelines in the upper tank and the lower tank be in a close state, turning on the valved pipelines between each of the upper tank and the lower tank and the externally connected independent vacuum system to adjust the pressure of the upper tank to −0.05~−0.055 MPa and adjust the pressure of the lower tank to −0.055~−0.06 MPa, and turning off the valved pipelines between each of the upper tank and the lower tank and the externally connected independent vacuum system when the pressure of the upper tank and lower tank reaches to preset values; turning on the valve of gas-pressure adjusting valved pipeline of each of the left and right mixing tanks so that the pressure in the left and right mixing tanks reaches to −0.02~−0.03 MPa; then turning on the plaster powder feeding valved pipeline, the mixed aqueous solution feeding pipeline and the valve between the mixed aqueous solution feeding pipeline and the mixed aqueous solution quantitative supply bucket of each of the left and right mixing tanks, so that each of the left and right mixing tanks is respectively conducted with the plaster powder quantitative supply bucket and the mixed aqueous solution quantitative supply bucket at atmospheric pressure; under the action of pressure difference, the quantitative plaster powder and quantitative mixed aqueous solution are inhaled into the left and right mixing tanks at high speed, and the initial mixing of the plaster powder and the mixed aqueous solution is realized by the collision between the plaster powder and the mixed aqueous solution; after the plaster powder and the mixed aqueous solution completely enter into each of the left and right mixing tanks, the plaster powder feeding valved pipeline, the mixed aqueous solution feeding pipeline and the valve between the mixed aqueous solution feeding pipeline and the mixed aqueous solution quantitative supply bucket of each of the left and right mixing tanks are turned off, and the gas pressure in each of the left and right mixing tanks is adjusted to −0.04~−0.05 Mpa by the valve of the gas-pressure adjusting valved pipeline of each of the left and right mixing tanks; at the same time, the spiral stirrer in each of the left and right mixing tanks starts to fall and stir the plaster slurry at a speed of 540~650 RPM (revolutions per minute), the bottom of the spiral stirrer is 40 mm away from the bottom of the mixing tank and the stirring time is 120~180 s.

Step 105: rising the spiral stirrers to the highest position on the top of the left and right mixing tanks after the stirring is completed, and turning on the valve of the discharge valved pipeline at the bottom of each of the left and right mixing tanks so that the plaster slurry in the each of the left and right mixing tanks flows into the plaster slurry transfer tube via the discharge valved pipeline under the action of gravity and pressure difference; and turning on the valve of the plaster slurry transfer tube within 3~5 s after turning on the discharge valved pipeline at the bottom of each of the left and right mixing tanks, so that the upper tank and the lower tank are conducted each other and the plaster slurry enters into the sand box with the wax patter to be filled in the lower tank via the sand box feed inlet under the action of gravity and pressure difference.

Step 106: rotating the rotatable wheel plate in the lower tank by 45° after the sand box in the lower tank is fully filled with the plaster slurry, so that the cleaning water box water inlet is aligned with the lower end of the plaster slurry transfer tube; at the same time, turning on, for each of the left and right mixing tanks, the mixed aqueous solution feeding pipeline and the valve between the mixed aqueous solution feeding pipeline and the tap water bucket, so that under the action of pressure difference, tap water sequentially enters into the left and right mixing tanks, the discharge valved pipeline and the plaster slurry transfer tube to perform a flushing processing on the residual plaster slurry, wherein the flushing time is 10~20 s, and the flushed tap water flows into the cleaning water box via the cleaning water box water inlet; turning off the all turned-on valves after the flushing processing is completed, and then separately turning on the pressure adjusting system of the lower tank so that the pressure of the lower tank becomes to atmospheric pressure.

Step 107: adjusting the hydraulic lifting pump of the middle partition to make the middle partition rise and transfer the lower tank to a region other than the gravity projection area of the middle partition by the guide rail, and lift out the plaster sand box in the lower tank by using a crane.

Step 8: performing a roasting process on the sand box filled with plaster to remove the wax pattern in the sand box and obtain a plaster casting mold. In the present application, for the roasting process, it may adopt the known method in the prior art, it will not be described herein.

Further, for the left and right tanks, a mixing and grouting process may be performed independently or simultaneously.

Further, in the step S101, the ratio of acetone and industrial ethanol in the mixture is 1~1.8:9~8.2.

Further, in the step S101, the waterproof-breathable membrane has the waterproof level of IPX4~IPX6, the diameter of the waterproof-breathable membrane is 8~14 mm, and the deviation of the center of the waterproof-breathable membrane from the center of the covered circular hole is no more than 2 mm.

A device for manufacturing a plaster casting mold for complicated structure aluminum alloy casting with a large inner cavity and a thin wall comprises: an upper tank 1, a lower tank 2, a middle partition 3, a rotatable wheel plate 4, a bottom board 5, a guide rail 6, a left spiral stirrer 7, a left mixing tank 8, a pressure adjusting valve 9 of lower tank, a hydraulic lifting pump 10 of middle partition, a right mixing tank 11, a right spiral stirrer 12, a plaster powder quantitative supply bucket 13 of right mixing tank, a valve 14, a mixed aqueous solution quantitative supply bucket 15 of right mixing tank, a right tap water bucket 16, a gas-pressure adjusting valved pipeline 17 of right mixing tank, a upper tank pressure adjusting valve 18, a gas-pressure adjusting valved pipeline 19 of left mixing tank, a left tap water bucket 20, a mixed aqueous solution quantitative supply bucket 21 of left mixing tank, a plaster powder quantitative supply bucket 22 of left mixing tank, a plaster slurry transfer tube 23, a sand box 24, a cleaning water box water inlet, a sand box feed inlet 26 and a cleaning water box 27.

The middle partition 3 is welded between the upper tank 1 and the lower tank 2, and the lower side of each of two ends of the middle partition 3 is fixed with the hydraulic lifting pump 10 of middle partition by bolts. Further, the bottom end of the lower tank 2 is fixed and connected to the rotatable wheel plate 4 on the upper side of the bottom board 5, and the lower end of the bottom board 5 is slidably connected to the inside of the guide rail 6 by rollers.

The left mixing tank 8 and the right mixing tank 11 are fixed in the upper tank 1 by a support frame, and the left spiral stirrer 7 and the right spiral stirrer 12 are fixed on the upper ends of the inside of the left mixing tank 8 and the right mixing tank 11 by bolts respectively. The left end of the left mixing tank 8 is conducted to the external plaster powder quantitative supply bucket 22 of left mixing tank by a tube, the right end of the left mixing tank 8 is conducted to the left tap water bucket 20 and the mixed aqueous solution quantitative supply bucket 21 of left mixing tank by tubes, and the upper end of the left mixing tank 8 is conducted with the gas-pressure adjusting valved pipeline 19 of left mixing tank. The right end of the right mixing tank 11 is conducted to the external plaster powder quantitative supply bucket 13 of right mixing tank by a tube, the left end of the right mixing tank 11 is conducted to the mixed aqueous solution quantitative supply bucket 15 of right mixing tank and the right tap water bucket 16 by tubes, and the upper end of the right mixing tank 11 is conducted with the gas-pressure adjusting valved pipeline 17 of right mixing tank.

The lower end of each of the left mixing tank 8 and the right mixing tank 11 is conducted to the plaster slurry transfer tube 23 by a pipeline, and the plaster slurry transfer tube 23 is located upon the sand box 24. The sand box 24 is welded at the central region of the bottom portion of the lower tank 2. The side surface of the sand box 24 is provided with the sand box feed inlet 26. The outer side of the sand box 24 is provided with the cleaning water box 27, and the side surface of the cleaning water box 27 is conducted with the cleaning water box water inlet 25.

The upper tank pressure adjusting valve 18 is conducted to the top end of the upper tank 1, and the lower tank pressure adjusting valve 9 is conducted to the side surface of the lower tank 2.

Hereinafter, the application principles of the present application are further described in combination with the specific embodiments.

First embodiment: circular tube-shaped casting with blind cavity of ZL102 of which the wall thickness of the main body is 3 mm and the height is 864 mm (two mixing tanks perform grouting of plaster simultaneously)

Step 1: A wax pattern of circular tube-shaped casting with blind cavity is fabricated by using a wax injection mold of aluminum alloy material. The wax pattern is placed in tap water of 20° C. for 35 minutes to be shaped, and then the internal surface and outer surface of the wax pattern are splashed and cleaned with a mixture of acetone and industrial ethanol (the ratio of them is 1:9). Through-holes are opened on blind cavity in the wax pattern of which the depth is more than 20 mm with respect to the opposite direction of gravity by using a drill bit with a diameter of 6 mm, wherein the axis lines of the holes are parallel to the gravity direction, and the distance between the holes is 40 mm. Then the upper and lower surfaces of the holes are stuck and covered with circle TPU waterproof-breathable membranes with thickness of 0.24 mm by using AB adhesive; and the wax pattern is placed in a sand box to be grouted. The waterproof-breathable membrane has the waterproof level of IPX6, the diameter of the waterproof-breathable membrane is 14 mm, and the deviation of the center of the waterproof-breathable membrane from the center of the covered circular hole is no more than 2 mm.

Step 2: A sealed tank is separated into an upper tank 1 and a lower tank 2 which are two independent spaces by a middle partition 3, wherein the upper tank 1 and the lower tank 2 can be used as two gas chambers in which gas pressure is controlled independently by a valve on a plaster slurry transfer tube 23, and the upper tank 1 and the lower tank 2 are respectively externally connected to independent pressure adjusting systems through valved pipelines 18 and 9, and left and right sealed mixing tanks 8 and 11 are respectively placed in the upper gas chamber. The upper portion of each of the left and right mixing tanks 8 and 11 is provided with a gas-pressure adjusting valved pipeline 19 and 17, and the lower portion of each of the left and right mixing tanks is provided with a plaster slurry discharge valved pipeline, wherein the gas-pressure adjusting valved pipelines 19 and 17 can control gas pressure independently relative to the upper tank 1, the plaster slurry discharge valved pipelines are connected with the plaster slurry transfer tube 23, a spiral stirrer 7 and 12 is installed in the center of the upper cover of each of the left and right mixing tanks, and the spiral stirrer can rise and fall vertically along the central axis line of the mixing tank; when the spiral stirrer rises to the highest point, its upper end is 60 mm away from the lower plane of the upper cover of the mixing tank, and when the spiral stirrer falls to the lowest point, its lower end is 40 mm away from the inner bottom plane of the mixing tank; one mixed plaster powder feeding valved pipeline and one mixed aqueous solution feeding pipeline are distributed symmetrically on the circumference of each of the left and right mixing tanks, which is 110 mm away from the upper plane of the mixing tank; the other end of the plaster powder feeding valved pipeline are respectively connected to plaster powder quantitative supply bucket 22, 13, and the other end of the mixed aqueous solution feeding pipeline is simultaneously connected to a mixed aqueous solution quantitative supply bucket 21, 15 and a tap water bucket 20, 16 via two valved pipelines in a parallel connection manner; the center lines of the plaster powder feeding valved pipeline and the mixed aqueous solution feeding pipeline are in the same straight line, and an angle between the center line and the axis line of the mixing tank is 90°.

Step 3: A sand box 24 to be grouted and an annular cleaning water box 27 are placed on a rotatable wheel plate 4 of the lower tank 2 together, wherein an angle between a central axis line of a cleaning water box water inlet 25 and a central axis line of a sand box feed inlet 26 is 45°; the lower tank 2 is transferred below the middle partition 3 by a guide rail 6, and the sand box feed inlet 26 directly faces to the bottom of the plaster slurry transfer tube 23; a hydraulic lifting pump 10 of the middle partition is adjusted so that the middle partition falls down and steadily contacts with the lower tank 2, and a leak-proof isolation is performed on the contact parts between the upper tank 1 and the middle partition 3 as well as the middle partition 3 and the lower tank 2 by using two sets of rubber pads.

Step 4: valves of all the pipelines in the upper tank and the lower tank are made be in a close state, the valved pipelines between each of the upper tank and the lower tank and the externally connected independent vacuum system are turned on to adjust the pressure of the upper tank to −0.05 MPa and adjust the pressure of the lower tank to −0.055 MPa, and the valved pipelines between each of the upper tank and the lower tank and the externally connected independent vacuum system are turned off when the pressure of the upper tank and lower tank reaches to a preset value; the valve of gas-pressure adjusting valved pipeline of each of the left and right mixing tanks are turned on so that the pressure in the left and right mixing tanks reaches to −0.02 MPa; then the plaster powder feeding valved pipeline, the mixed aqueous solution feeding pipeline and the valve between the mixed aqueous solution feeding pipeline and the mixed aqueous solution quantitative supply bucket of each of the left and right mixing tanks are turned on, so that each of the left and right mixing tanks is respectively conducted with the plaster powder quantitative supply bucket and the mixed aqueous solution quantitative supply bucket at atmospheric pressure; under the action of pressure difference, the quantitative plaster powder and quantitative mixed aqueous solution are inhaled into the left and right mixing tanks at high speed, and the initial mixing of the plaster powder and the mixed aqueous solution is realized by the collision between the plaster powder and the mixed aqueous solution; after the plaster powder and the mixed aqueous solution completely enter into each of the left and right mixing tanks, the plaster powder feeding valved pipeline, the mixed aqueous solution feeding pipeline and the valve between the mixed aqueous solution feeding pipeline and the mixed aqueous solution quantitative supply bucket of each of the left and right mixing tanks are turned off, and the gas pressure in each of the left and right mixing tanks is adjusted to −0.04 MPa by the valve of the gas-pressure adjusting valved pipeline of each of the left and right mixing tanks; at the same time, the spiral stirrer in each of the left and right mixing tanks starts to fall and stir the plaster slurry at a speed of 540 RPM, the bottom of the spiral stirrer is 40 mm away from the bottom of the mixing tank, and the stirring time is 120 s.

Step 5: the spiral stirrers are raised to the highest position on the top of the left and right mixing tanks after the stirring is completed, and the valve of the discharge valved pipeline at the bottom of each of the left and right mixing tanks are turned on so that the plaster slurry in the each of the left and right mixing tanks flows into the plaster slurry transfer tube via the discharge valved pipeline under the action of gravity and pressure difference; and the valve of the plaster slurry transfer tube is turned on, within 3 s after the discharge valved pipeline at the bottom of each of the left and right mixing tanks is turned on, so that the upper tank and the lower tank are conducted each other and the plaster slurry enters into the sand box to be filled in the lower tank via the sand box feed inlet under the action of gravity and pressure difference. Wherein, the height difference in the top plane of plaster slurry in the inside and outside of the wax pattern in the sand box is about 10 mm.

Step 6: the rotatable wheel plate in the lower tank is rotated by 45° after the sand box in the lower tank is fully filled with the plaster slurry, so that the cleaning water box water inlet is aligned with the lower end of the plaster slurry transfer tube; at the same time, the mixed aqueous solution feeding pipeline and the valve between the mixed aqueous solution feeding pipeline and the tap water bucket are turned on for each of the left and right mixing tanks, so that under the action of pressure difference, tap water sequentially enters into the left and right mixing tanks, the discharge valved pipelines and the plaster slurry transfer tube to perform a flushing processing on the residual plaster slurry in the pipelines and the tube, wherein the flushing time is 10 s and the flushed tap water flows into the cleaning water box via the cleaning water box water inlet; the all turned-on valves are turned off after the flushing processing is completed, and then the pressure adjusting system of the lower tank is turned on separately so that the pressure of the lower tank becomes to atmospheric pressure.

Step 7: the hydraulic lifting pump of the middle partition is adjusted to make the middle partition rise and transfer the lower tank to a region other than the gravity projection area of the middle partition by the guide rail, and lift out the plaster sand box in the lower tank by using a crane.

Thereafter, a roasting process is performed on the sand box filled with plaster to remove the wax pattern in the sand box and obtain a plaster casting mold.

For the circular tube-shaped casting with blind cavity of ZL102 produced by the investment plaster casting mold fabricated by the present application, the maximum circumcircle diameter of granular projections on the inner and outer surfaces is 3 mm; there are no more than 2 projections with diameter greater than 2 mm within an area of 30×30 mm on the surface of aluminum alloy casting; dimension tolerance of the casting is CT7; and there is no crack in the casting.

Second embodiment: square cabin casting with a partition at its middle portion of ZL101A of which the wall thickness of the main body is 2.6 mm and the diameter is 910 mm (two mixing tanks perform asynchronously mixing and grouting of plaster)

Step 1: A wax pattern of square cabin casting with a partition at its middle portion is fabricated by using a wax injection mold of aluminum alloy material. The wax pattern is placed in tap water of 24° C. for 30 minutes to be shaped, and then the internal surface and outer surface of the wax pattern are splashed and cleaned with a mixture of acetone and industrial ethanol (the ratio of them is 1.8:8.2). Through-holes are opened on a partition which is vertical to the gravity direction and has an area of more than 1600 $mm^2$ by using a drill bit with a diameter of 3 mm, wherein the axis lines of the holes are parallel to the gravity direction, and the distance between the holes is 30 mm. Then the upper and lower surfaces of the holes are stuck and covered with circle TPU waterproof-breathable membranes with thickness of 0.16 mm by using AB adhesive; and thereafter the wax pattern is placed in a sand box to be grouted. The waterproof-breathable membrane has the waterproof level of IPX4, the diameter of the waterproof-breathable membrane is 8 mm, and the deviation of the center of the waterproof-breathable membrane from the center of the covered circular hole is no more than 1.5 mm.

Step 2: A sealed tank is separated into an upper tank 1 and a lower tank 2 which are two independent spaces by a middle partition 3, wherein the upper tank 1 and the lower tank 2 can be used as two gas chambers in which gas pressure is controlled independently by a valve on a plaster slurry transfer tube 23, and the upper tank 1 and the lower tank 2 are respectively externally connected to independent pressure adjusting systems through valved pipelines 18 and 9, and left and right sealed mixing tanks 8 and 11 are respectively placed in the upper gas chamber. The upper portion of each of the left and right mixing tanks 8 and 11 is provided with a gas-pressure adjusting valved pipeline 19, 17, and the lower portion of each of the left and right mixing tanks is provided with a plaster slurry discharge valved pipeline, wherein the gas-pressure adjusting valved pipelines 19 and 17 can control gas pressure independently relative to the upper tank 1, the plaster slurry discharge valved pipelines are connected with the plaster slurry transfer tube 23, a spiral stirrer 7, 12 is installed in the center of the upper cover of each of the left and right mixing tanks, and the spiral stirrer can rise and fall vertically along the central axis line of the mixing tank; when the spiral stirrer rises to the highest point, its upper end is 60 mm away from the lower plane of the upper cover of the mixing tank, and when the spiral stirrer falls to the lowest point, its lower end is 40 mm away from the inner bottom plane of the mixing tank; one mixed plaster powder feeding valved pipeline and one mixed aqueous solution feeding pipeline are distributed symmetrically on the circumference of each of the left and right mixing tanks, which is 100 mm away from the upper plane of the mixing tank; the other end of the plaster powder feeding valved pipeline are respectively connected to plaster powder quantitative supply bucket 22, 13, and the other end of the mixed aqueous solution feeding pipeline is simultaneously connected to a mixed aqueous solution quantitative supply bucket 21, 15 and a tap water bucket 20, 16 via two valved pipelines in a parallel connection manner; the center lines of the plaster powder feeding valved pipeline and the mixed aqueous solution feeding pipeline are in the same straight line, and an angle between the center line and the axis line of the mixing tank is 90°.

Step 3: A sand box 24 to be grouted and an annular cleaning water box 27 are placed on a rotatable wheel plate 4 of the lower tank 2 together, wherein an angle between a central axis line of a cleaning water box water inlet 25 and a central axis line of a sand box feed inlet 26 is 45°; the lower tank 2 is transferred below the middle partition 3 by a guide rail 6, and the sand box feed inlet 26 directly faces to the bottom of the plaster slurry transfer tube 23; a hydraulic lifting pump 10 of the middle partition is adjusted so that the middle partition falls down and steadily contacts with the lower tank 2, wherein a leak-proof isolation is performed on the contact parts between the upper tank 1 and the middle partition 3 as well as the middle partition 3 and the lower tank 2 by using two sets of rubber pads.

Step 4: Valves of all the pipelines in the upper tank 1 and the lower tank 2 are made be in a close state, the valved pipelines between each of the upper tank and the lower tank and the externally connected independent vacuum system are turned on to adjust the pressure of the upper tank to −0.055 MPa and adjust the pressure of the lower tank to −0.06 MPa, and the valved pipelines between each of the upper tank and the lower tank and the externally connected independent vacuum system are turned off when the pressure of the upper tank and lower tank reaches to preset values; the valve of gas-pressure adjusting valved pipeline 19 of the left mixing tank 8 is turned on so that the pressure in the left mixing tank 8 reaches to −0.03 MPa; then the plaster powder feeding valved pipeline, the mixed aqueous solution feeding pipeline and the valve between the mixed aqueous solution feeding pipeline and the mixed aqueous solution quantitative supply bucket 21 of the left mixing tank 8 are turned on, so that the left mixing tank 8 is conducted with the plaster powder quantitative supply bucket 22 and the mixed aqueous solution quantitative supply bucket 21 at atmospheric pressure; under the action of pressure difference, the quantitative plaster powder and quantitative mixed aqueous solution are inhaled into the left mixing tank at high speed, and the initial mixing of the plaster powder and the mixed aqueous solution is realized by the collision between the plaster powder and the mixed aqueous solution; after the plaster powder and the mixed aqueous solution completely enter into the left mixing tank 8, the plaster powder feeding valved pipeline, the mixed aqueous solution feeding pipeline and the valve between the mixed aqueous solution feeding pipeline and the mixed aqueous solution quantitative supply bucket 21 of the left mixing tank 8 are turned off, and the gas pressure in the left mixing tank is adjusted to −0.05 MPa by the valve of the gas-pressure adjusting valved pipeline 19 of the left mixing tank 8; at the same time, the spiral stirrer 7 in the left mixing tank 8 starts to fall and stir the plaster slurry at a speed of 650 RPM, the bottom of the spiral stirrer 7 is 40 mm away from the bottom of the left mixing tank 8, and the stirring time is 180 s.

Step 5: The spiral stirrer 7 of the left mixing tank 8 is raised to move upward after the stirring in the left mixing tank is completed; at the same time, the valve of gas-pressure adjusting valved pipeline 17 of the right mixing tank 11 is turned on so that the pressure in the right mixing tank 11 reaches to −0.03 MPa; then the plaster powder feeding valved pipeline, the mixed aqueous solution feeding pipeline and the valve between the mixed aqueous solution feeding pipeline and the mixed aqueous solution quantitative supply bucket 15 of the right mixing tank 11 are turned on, so that the right mixing tank 11 is conducted with the plaster powder quantitative supply bucket 13 and the mixed aqueous solution quantitative supply bucket 15 at atmospheric pressure; under the action of pressure difference, the quantitative plaster powder and quantitative mixed aqueous solution are inhaled into the right mixing tank 11 at high speed, and the initial mixing of the plaster powder and the mixed aqueous solution is realized by the collision between the plaster powder and the mixed aqueous solution; after the plaster powder and the mixed aqueous solution completely enter into the right mixing tank 11, the plaster powder feeding valved pipeline, the mixed aqueous solution feeding pipeline and the valve between the mixed aqueous solution feeding pipeline and the mixed aqueous solution quantitative supply bucket 15 of the right mixing tank 11 are turned off, and the gas pressure in the right mixing tank 11 is adjusted to −0.05 MPa by the valve of the gas-pressure adjusting valved pipeline 17 of the right mixing tank 11; at the same time, the spiral stirrer 12 in the right mixing tank 11 starts to fall and stir the plaster slurry at a speed of 650 RPM, the bottom of the spiral stirrer 11 is 40 mm away from the bottom of the right mixing tank 11, and the stirring time is 180 s.

Step 6: When the spiral stirrer 7 in the left mixing tank 8 is raised to the highest position on the top of the left mixing tank 8, the valve of the discharge valved pipeline at the bottom of the left mixing tank 8 is turned on so that the plaster slurry in the left mixing tank 8 flows into the plaster slurry transfer tube 23 via the discharge valved pipeline under the action of gravity and pressure difference; and the valve of the plaster slurry transfer tube 23 is turned on, at time of 5 s after the discharge valved pipeline at the bottom of the left mixing tank 8 is turned on, so that the upper tank 1 and the lower tank 2 are conducted each other and the plaster slurry enters into the sand box 24 to be filled in the lower tank 2 via the sand box feed inlet 26 under the action of gravity and pressure difference.

Step 7: When there is no plaster slurry in the left mixing tank 8 flowing into the sand box 24 of the lower tank 2, the valve of the discharge valved pipeline at the bottom of the left mixing tank 8 is turned off, the valve of the plaster slurry transfer tube 23 is turned off, and the pipelines with valves 9 and 18 between each of the upper tank 1 and the lower tank 2 and the externally connected independent vacuum system are turned on to adjust the pressure in the upper tank 1 to −0.055 MPa and adjust the pressure in the lower tank 2 to −0.06 MPa; when the pressure in the upper tank and lower tank respectively reaches to preset values, the valved pipelines between each of the upper tank and the lower tank and the externally connected independent vacuum system are turned off; when the spiral stirrer 12 in the right mixing tank 11 is raised to the highest position on the top of the mixing tank after the stirring of the plaster slurry in the right mixing tank is completed, the valve of the discharge valved pipeline at the bottom of the right mixing tank is turned on so that the plaster slurry in the right mixing tank flows into the plaster slurry transfer tube 23 via the discharge valved pipeline under the action of gravity and pressure difference; and the valve of the plaster slurry transfer tube 23 is turned on, at time of 5 s after the discharge valved pipeline at the bottom of the right mixing tank 11 is turned on, so that the upper tank and the lower tank are conducted each other and the plaster slurry enters into the sand box 24 to be filled in the lower tank via the sand box feed inlet 26 under the action of gravity and pressure difference; when there is no plaster slurry in the right mixing tank 11 flowing into the sand box of the lower tank, the valve of the discharge valved pipeline at the bottom of the right mixing tank is turned off, the valve of the plaster slurry transfer tube is turned off, and the valved pipelines between each of the upper tank and the lower tank and the externally connected independent vacuum system are turned on to adjust the pressure in the upper tank to −0.055 MPa and adjust the pressure in the lower tank to −0.06 MPa; when the pressure in the upper tank and lower tank respectively reaches to preset values, the valved pipelines between each of the upper tank and the lower tank and the externally connected independent vacuum system are turned off.

Step 8: At the same time when the stirring in the right mixing tank 11 is completed, the valve of gas-pressure adjusting valved pipeline 19 of the left mixing tank 8 is turned on so that the pressure in the left mixing tank reaches to −0.03 MPa; then the plaster powder feeding valved pipeline, the mixed aqueous solution feeding pipeline and the valve between the mixed aqueous solution feeding pipeline and the mixed aqueous solution quantitative supply bucket 21 of the left mixing tank 8 are turned on, so that the left mixing tank 8 is conducted with the plaster powder quantitative supply bucket 22 and the mixed aqueous solution quantitative supply bucket 21 at atmospheric pressure; under the action of pressure difference, the quantitative plaster powder and quantitative mixed aqueous solution are inhaled into the left mixing tank at high speed, and the initial mixing of the plaster powder and the mixed aqueous solution is realized by the collision between the plaster powder and the mixed aqueous solution; after the plaster powder and the mixed aqueous solution completely enter into the left mixing tank 8, the plaster powder feeding valved pipeline, the mixed aqueous solution feeding pipeline and the valve between the mixed aqueous solution feeding pipeline and the mixed aqueous solution quantitative supply bucket 21 of the left mixing tank 8 are turned off, and the gas pressure in the left mixing tank is adjusted to −0.05 MPa by the valve of the gas-pressure adjusting valved pipeline 19 of the left mixing tank; at the same time, the spiral stirrer 7 in the left mixing tank 8 starts to fall and stir the plaster slurry at a speed of 650 RPM, the bottom of the spiral stirrer 7 is 40 mm away from the bottom of the mixing tank, and the stirring time is 180 s.

Step 9: the steps 4 to 8 are repeated until the sand box 24 in the lower tank 2 is fully filled with the plaster slurry.

Step 10: The rotatable wheel plate 4 in the lower tank is rotated by 45° after the sand box 24 in the lower tank is fully filled with the plaster slurry, so that the cleaning water box water inlet 25 is aligned with the lower end of the plaster slurry transfer tube 23; at the same time, the mixed aqueous solution feeding pipeline and the valve between the mixed aqueous solution feeding pipeline and the tap water bucket are turned on for each of the left and right mixing tanks, so that under the action of pressure difference, tap water sequentially enters into the left and right mixing tanks, the discharge valved pipelines and the plaster slurry transfer tube to perform a flushing processing on the residual plaster slurry, wherein the flushing time is 20 s and the flushed tap water flows into the cleaning water box via the cleaning water box water inlet; the all turned-on valves are turned off after the flushing processing is completed, and then the pressure adjusting system of the lower tank is turned on separately so that the pressure of the lower tank becomes to atmospheric pressure.

Step 11: The hydraulic lifting pump 10 of the middle partition 3 is adjusted to make the middle partition rise and transfer the lower tank to a region other than the gravity projection area of the middle partition by the guide rail, and lift out the plaster sand box in the lower tank by using a crane.

Thereafter, a roasting process is performed on the sand box filled with plaster to remove the wax pattern in the sand box and obtain a plaster casting mold.

For the square cabin casting with a partition at its middle portion of ZL101A produced by the investment plaster casting mold fabricated by the present application, the maximum circumcircle diameter of granular projections on the inner and outer surfaces is 2.6 mm; there is one projection with diameter greater than 2 mm within an area of 30×30 mm on the surface of aluminum alloy casting; dimension tolerance of the casting is CT6; and there is no crack in the casting.

Third embodiment: jar-shaped variable section casting of Z1114A of which the wall thickness of the main body is 2.4 mm and the height is 810 mm (two mixing tanks perform grouting of plaster together)

Step 1: A wax pattern of jar-shaped variable section casting is fabricated by using a wax injection mold of aluminum alloy material. The wax pattern is firstly placed in tap water of 22° C. for 35 minutes to be shaped, and then the internal surface and outer surface of the wax pattern are splashed and cleaned with a mixture of acetone and industrial ethanol (the ratio of them is 1.5:8.5). Through-holes are opened on a blind cavity in the wax pattern of which the depth is more than 20 mm with respect to the opposite direction of gravity by using a drill bit with a diameter of 4 mm, wherein the axis lines of the holes are parallel to the gravity direction, and the distance between the holes is 20 mm. Then the upper and lower surfaces of the holes are stuck and covered with circle TPU waterproof-breathable membranes with thickness of 0.2 mm by using AB adhesive; and thereafter the wax pattern is placed in a sand box to be grouted. The waterproof-breathable membrane has the waterproof level of IPX-5, the diameter of the waterproof-breathable membrane is 10 mm, and the deviation of the center of the waterproof-breathable membrane from the center of the covered circular hole is no more than 1.5 mm.

Step 2: A sealed tank is separated into an upper tank 1 and a lower tank 2 which are two independent spaces by a middle partition 3, wherein the upper tank 1 and the lower tank 2 can be used as two gas chambers in which gas pressure is controlled independently by a valve on a plaster slurry transfer tube 23, and the upper tank 1 and the lower tank 2 are respectively externally connected to independent pressure adjusting systems through valved pipelines 18 and 9, and left and right sealed mixing tanks 8 and 11 are respectively placed in the upper gas chamber. The upper portion of each of the left and right mixing tanks 8 and 11 is provided with a gas-pressure adjusting valved pipeline 19 and 17, and the lower portion of each of the left and right mixing tanks is provided with a plaster slurry discharge valved pipeline, wherein the gas-pressure adjusting valved pipelines 19 and 17 can control gas pressure independently relative to the upper tank 1, the plaster slurry discharge valved pipelines are connected with the plaster slurry transfer tube 23, a spiral stirrer is installed in the center of the upper cover of each of the left and right mixing tanks, and the spiral stirrer can rise and fall vertically along the central axis line of the mixing tank; when the spiral stirrer rises to the highest point, its upper end is 60 mm away from the lower plane of the upper cover of the mixing tank, and when the spiral stirrer falls to the lowest point, its lower end is 40 mm away from the inner bottom plane of the mixing tank; one mixed plaster powder feeding valved pipeline and one mixed aqueous solution feeding pipeline are distributed symmetrically on the circumference of each of the left and right mixing tanks, which is 105 mm away from the upper plane of the mixing tank; the other end of the plaster powder feeding valved pipeline are respectively connected to plaster powder quantitative supply bucket 22, 13, and the other end of the mixed aqueous solution feeding pipeline is simultaneously connected to a mixed aqueous solution quantitative supply bucket 21, 15 and a tap water bucket 20, 16 via two valved pipelines in a parallel connection manner; the center lines of the plaster powder feeding valved pipeline and the mixed aqueous solution feeding pipeline are in the same straight line, and an angle between the center line and the axis line of the mixing tank is 90°.

Step 3: A sand box 24 to be grouted and an annular cleaning water box 27 are placed on a rotatable wheel plate 4 of the lower tank 2 together, wherein an angle between a central axis line of a cleaning water box water inlet 25 and a central axis line of a sand box feed inlet 26 is 45°; the lower tank 2 is transferred below the middle partition 3 by a guide rail 6, and the sand box feed inlet 26 directly faces to the bottom of the plaster slurry transfer tube 23; a hydraulic lifting pump 10 of the middle partition is adjusted so that the middle partition falls down and steadily contacts with the lower tank 2, and wherein a leak-proof isolation is performed on the contact parts between the upper tank 1 and the middle partition 3 as well as the middle partition 3 and the lower tank 2 by using two sets of rubber pads.

Step 4: Valves of all the pipelines in the upper tank 1 and the lower tank 2 are made be in a close state, the valved pipelines between each of the upper tank and the lower tank and the externally connected independent vacuum system are turned on to adjust the pressure of the upper tank to −0.053 MPa and adjust the pressure of the lower tank to −0.058 MPa, and the valved pipelines between each of the upper tank and the lower tank and the externally connected independent vacuum system are respectively turned off when the pressure of the upper tank and lower tank reaches to preset values; the valve of gas-pressure adjusting valved pipeline of each of the left and right mixing tanks are turned on so that the pressure in the left and right mixing tanks reaches to −0.025 MPa; then the plaster powder feeding valved pipeline, the mixed aqueous solution feeding pipeline and the valve between the mixed aqueous solution feeding pipeline and the mixed aqueous solution quantitative supply bucket of each of the left and right mixing tanks are turned on, so that each of the left and right mixing tanks is respectively conducted with the plaster powder quantitative supply bucket and the mixed aqueous solution quantitative supply bucket at atmospheric pressure; under the action of pressure difference, the quantitative plaster powder and quantitative mixed aqueous solution are inhaled into the left and right mixing tanks at high speed, and the initial mixing of the plaster powder and the mixed aqueous solution is realized by the collision between the plaster powder and the mixed aqueous solution; after the plaster powder and the mixed aqueous solution completely enter into the left and right mixing tanks, the plaster powder feeding valved pipeline, the mixed aqueous solution feeding pipeline and the valve between the mixed aqueous solution feeding pipeline and the mixed aqueous solution quantitative supply bucket of each of the left and right mixing tanks are turned off, and the gas pressure in each of the left and right mixing tanks is adjusted to −0.045 MPa by the valve of the gas-pressure adjusting valved pipeline of each of the left and right mixing tanks; at the same time, the spiral stirrer in each of the left and right mixing tanks starts to fall and stir the plaster slurry at a speed of 610 RPM, the bottom of the spiral stirrer is 40 mm away from the bottom of the mixing tank, and the stirring time is 150 s.

Step 5: the spiral stirrers 8 and 11 are raised to the highest position on the top of the left and right mixing tanks after the stirring is completed, and the valve of the discharge valved pipeline at the bottom of each of the left and right mixing tanks are turned on so that the plaster slurry in the each of the left and right mixing tanks flows into the plaster slurry transfer tube via the discharge valved pipeline under the action of gravity and pressure difference; and the valve of the plaster slurry transfer tube is turned on, within 4 s after the discharge valved pipeline at the bottom of each of the left and right mixing tanks is turned on, so that the upper tank and the lower tank are conducted each other and the plaster slurry enters into the sand box to be filled in the lower tank via the sand box feed inlet under the action of gravity and pressure difference. Wherein the height difference in the top plane of plaster slurry in the inside and outside of the wax pattern is about 5 mm.

Step 6: The rotatable wheel plate in the lower tank is rotated by 45° after the sand box in the lower tank is fully filled with the plaster slurry, so that the cleaning water box water inlet is aligned with the lower end of the plaster slurry transfer tube; at the same time, the mixed aqueous solution feeding pipeline and the valve between the mixed aqueous solution feeding pipeline and the tap water bucket are turned on for each of the left and right mixing tanks, so that under the action of pressure difference, tap water sequentially enters into the left and right mixing tanks, the discharge valved pipelines and the plaster slurry transfer tube to perform a flushing processing on the residual plaster slurry, wherein the flushing time is 16 s, and the flushed tap water flows into the cleaning water box via the cleaning water box water inlet; the all turned-on valves are turned off after the flushing processing is completed, and then the pressure adjusting system of the lower tank is turned on separately so that the pressure of the lower tank becomes to atmospheric pressure.

Step 7: The hydraulic lifting pump of the middle partition is adjusted to make the middle partition rise and transfer the lower tank to a region other than the gravity projection area of the middle partition by the guide rail, and lift out the plaster sand box in the lower tank by using a crane.

Thereafter, a roasting process is performed on the sand box filled with plaster to remove the wax pattern in the sand box and obtain a plaster casting mold.

For the jar-shaped variable section casting of Z1114A produced by the investment plaster casting mold fabricated by the present application, the maximum circumcircle diameter of granular projections on the inner and outer surfaces is 2.2 mm; the number of projections with diameter greater than 2 mm is two within an area of 30×30 mm on the surface of aluminum alloy casting; the dimension tolerance of the casting is CT6; and there is no crack in the casting.

The foregoing are only preferred embodiments of the present application and are not intended to limit the present application, and any modifications, equivalent replacements and improvements made in the spirit and principles of the present application shall be covered by the protection scopes of the present application.

What is claimed is:

1. A plaster casting mold fabrication method for an aluminum alloy casting with an inner cavity and a wall, comprising the following steps:

Step 1: fabricating a wax pattern by using a wax injection mold of aluminum alloy material; placing the wax pattern in tap water of 20~24° C. for 25~35 minutes to be shaped; then splashing and cleaning an internal surface and outer surface of the wax pattern with a mixture of acetone and ethanol; opening through-holes on blind cavity in the wax pattern of which a depth is more than 20 mm with respect to an opposite direction of a gravity direction and/or on a partition which is vertical to the gravity direction and has an area of more than 1600 $mm^2$ by using a drill bit with a diameter of 3~6 mm, wherein the axis lines of the through-holes are parallel to the gravity direction, and a distance between the through-holes is 20~40 mm; sticking and covering the upper and lower surfaces of the holes through-holes with circle TPU waterproof-breathable membranes with thickness of 0.16~0.24 mm by using AB adhesive; and then placing the wax pattern in a sand box to be grouted;

Step 2: separating a sealed tank into an upper tank and a lower tank which are two independent spaces by a middle partition, wherein the upper tank and the lower tank can be used as two gas chambers in which gas pressure is controlled independently by a valve on a plaster slurry transfer tube, and the upper tank and the lower tank are respectively externally connected to independent pressure adjusting systems through valved pipelines, and left and right sealed mixing tanks are respectively placed in an upper gas chamber; an upper portion of each of the left and right mixing tanks is provided with a gas-pressure adjusting valved pipeline, and a lower portion of each of the left and right mixing tanks is provided with a plaster slurry discharge valved pipeline; the gas-pressure adjusting valved pipelines can independently perform a gas pressure control relative to the upper tank, and the plaster slurry discharge valved pipelines are connected with the plaster slurry transfer tube; a spiral stirrer is installed in a center of an upper cover of each of the left and right mixing tanks, and the spiral stirrer can rise and fall vertically along an axis line of the mixing tank; when the spiral stirrer rises to the highest point, its upper end is 60 mm away from a lower plane of the upper cover of the mixing tank, and when the spiral stirrer falls to the lowest point, its lower end is 40 mm away from an inner bottom plane of the mixing tank; one mixed plaster powder feeding valved pipeline and one mixed aqueous solution feeding pipeline are distributed symmetrically on a circumference of each of the left and right mixing tanks, which is 100~110 mm away from an upper plane of the mixing tank; another end of the plaster powder feeding valved pipeline is connected to a plaster powder quantitative supply bucket, and another end of the mixed aqueous solution feeding pipeline is simultaneously connected to a mixed aqueous solution quantitative supply bucket and a tap water bucket via two valved pipelines in a parallel connection manner; center lines of the plaster powder feeding valved pipeline and the mixed aqueous solution feeding pipeline are in a same straight line, and an angle between the straight line and the axis line of the mixing tank is 90°;

Step 3: placing the sand box to be grouted and an annular cleaning water box on a rotatable wheel plate of the lower tank together, wherein an angle between a central axis line of a cleaning water box water inlet and a central axis line of a sand box feed inlet is 45°; the lower tank is transferred below the middle partition by a guide rail, and the sand box feed inlet directly faces to a bottom of the plaster slurry transfer tube; a hydraulic lifting pump of the middle partition is adjusted so that the middle partition falls down and contacts with the lower tank, wherein a leak-proof isolation is performed on contact parts between the upper tank and the middle partition as well as the middle partition and the lower tank by using two sets of rubber pads;

Step 4: making valves of the pipelines in the upper tank and the lower tank be in a close state, turning on the valved pipelines between each of the upper tank and the lower tank and an externally connected independent vacuum system to adjust pressure in the upper tank to −0.05~0.055 MPa and adjust pressure in the lower tank to −0.055~0.06 MPa, and respectively turning off the valved pipelines between each of the upper tank and the lower tank and the externally connected independent vacuum system when the pressure of the upper tank and lower tank reaches to preset values; turning on a valve of gas-pressure adjusting valved pipeline of each of the left and right mixing tanks so that pressure in the left and right mixing tanks reaches to −0.02~0.03 MPa; then respectively turning on, for the left and right mixing tanks, the plaster powder feeding valved pipeline, the mixed aqueous solution feeding pipeline and the valve between the mixed aqueous solution feeding pipeline and the mixed aqueous solution quantitative supply bucket, so that each of the left and right mixing tanks is respectively conducted with the plaster powder quantitative supply bucket and the mixed aqueous solution quantitative supply bucket at atmospheric pressure, and under action of pressure difference, the quantitative plaster powder and quantitative mixed aqueous solution are inhaled into the left and right mixing tanks, and an initial mixing of the plaster powder and the mixed aqueous solution is realized by collision between the plaster powder and the mixed aqueous solution; after the plaster powder and the mixed aqueous solution completely enter into the left and right mixing tanks, turning off, for left and right mixing tanks, the plaster powder feeding valved pipeline, the mixed aqueous solution feeding pipeline and the valve between the mixed aqueous solution feeding pipeline and the mixed aqueous solution quantitative supply bucket, and adjusting pressure in each of the left and right mixing tanks to −0.04~0.05 MPa by a valve of the gas-pressure adjusting valved pipeline of each of the left and right mixing tanks; at the same time, making the spiral stirrer in each of the left and right mixing tanks fall and stir the plaster slurry at a speed of 540~650 RPM, a bottom of the spiral stirrer is 40 mm away from a bottom of the mixing tank, and stirring time is 120~180s;

Step 5: raising the spiral stirrers to the highest position on top of the left and right mixing tanks after the stirring is completed, and respectively turning on a valve of the discharge valved pipeline at the bottom of each of the left and right mixing tanks so that the plaster slurry in the each of the left and right mixing tanks flows into the plaster slurry transfer tube via the discharge valved pipeline under action of gravity and pressure difference; and turning on the valve of the plaster slurry transfer tube, within 3~5s after the discharge valved pipeline at the bottom of each of the left and right mixing tanks is turned on, so that the upper tank and the lower tank are conducted with each other and the plaster slurry enters into the sand box to be filled in the lower tank via the sand box feed inlet under action of gravity and pressure difference;

Step 6: rotating the rotatable wheel plate in the lower tank by 45° after the sand box in the lower tank is filled with the plaster slurry, so that the cleaning water box water inlet is aligned with a lower end of the plaster slurry transfer tube; at the same time, turning on, for the left and right mixing tanks, the mixed aqueous solution feeding pipeline and the valve between the mixed aqueous solution feeding pipeline and the tap water bucket, so that under action of pressure difference, tap water sequentially enters into the left and right mixing tanks, the discharge valved pipelines and the plaster slurry transfer tube to perform a flushing processing on residual plaster slurry, wherein flushing time is 10~20s, and flushed tap water flows into the cleaning water box via the cleaning water box water inlet; turning off all turned-on valves after the flushing processing is completed; and then separately turning on the pressure adjusting system of the lower tank so that pressure of the lower tank becomes to atmospheric pressure;

Step 7: adjusting the hydraulic lifting pump of the middle partition to make the middle partition rise and transfer the lower tank to a region other than a gravity projection area of the middle partition by the guide rail, and lift out the sand box filled with plaster in the lower tank by using a crane; and Step 8: performing a roasting process on the sand box filled with plaster to remove the wax pattern in the sand box and obtain a plaster casting mold.

2. The plaster casting mold fabrication method for the aluminum alloy casting with the inner cavity and the wall according to claim 1, wherein, in the Step 1, a ratio of acetone and industrial ethanol in the mixture is 1~1.8:9~8.2.

3. The plaster casting mold fabrication method for the aluminum alloy casting with the inner cavity and the wall according to claim 1, wherein, in the Step 1, the waterproof-breathable membrane has a waterproof level of IPX4~IPX6, a diameter of the waterproof-breathable membrane is 8~14 mm, and a deviation of a center of the waterproof- breathable membrane from a center of a covered circular hole is no more than 2 mm.

4. The plaster casting mold fabrication method for the aluminum alloy casting with the inner cavity and the wall according to claim 1, wherein, the left and right tanks can perform the mixing process independently or simultaneously.

5. The plaster casting mold fabrication method the aluminum alloy casting with the inner cavity and the wall according to claim 1, wherein, in the Step 5, a height difference in a top plane of plaster slurry inside and outside of the wax pattern is not more than 10 mm.

* * * * *